United States Patent [19]

Asher

[11] 4,447,850

[45] May 8, 1984

[54] ELECTRONIC LOCK

[76] Inventor: Eldad B. Asher, 32 Margalit St., Haifa, Israel

[21] Appl. No.: 340,840

[22] Filed: Jan. 20, 1982

[30] Foreign Application Priority Data

Feb. 1, 1981 [IL] Israel ..... 62037

[51] Int. Cl.[3] ..... E05B 49/00

[52] U.S. Cl. ..... 361/172; 307/10 AT

[58] Field of Search ..... 361/171, 172; 307/10 AT; 340/825.31, 825.32, 825.62, 825.64, 825.65, 825.68

[56] References Cited

U.S. PATENT DOCUMENTS

| | | | |
|---|---|---|---|
| 3,587,051 | 6/1971 | Hovey | 361/172 X |
| 3,660,729 | 5/1972 | James et al. | 361/172 |
| 3,831,065 | 8/1974 | Martin et al. | 361/172 |
| 4,209,709 | 6/1980 | Betton | 361/172 X |

*Primary Examiner*—Harry E. Moose, Jr.

*Attorney, Agent, or Firm*—Larson and Taylor

[57] ABSTRACT

A digital-code operated circuit for an electronic lock is provided. The circuit comprises a switch means to alternatingly close and open a circuit to provide pulses of specific numbers and groupings. The groupings constitute digits and sequence of digits respectively, converting means to convert the number of the pulses per digit and the number of the groupings per digit sequence from serial to parallel. The circuit also comprises discrimination means to distinguish between discrete pulses constituting a single digit and between complete digits constituting a digit sequence, memory means to store the data produced by the converting means, program means in which the digital code can be set, and verification means to verify whether the pulses provided by the pushbutton means produce digit sequences conforming to the digital code as set in the program means, wherein a signal for the unlocking of the lock is provided only by conformance with the code.

12 Claims, 4 Drawing Figures

ELECTRONIC LOCK

The present invention relates to an electronic lock, more particularly to an electronic lock having a single pushbutton.

Because of their ultimate "pickability", mechanical locks, however complex and sophisticated, are essentially unreliable and many attempts have been made, therefore, to replace them by locking means less susceptible to the deft application of hooks, hairpins an similar basic hardware. With the coming of solid-state electronics and, particularly, with the IC-breakthrough and the development of electronic logic circuits, several electronically operated locks have been proposed and are indeed on the market. Basically, these locks consist of the conventional electromechanical components such as a spring bolt retractable by a solenoid, and of the electronic section which enable the electromechanical components upon "keying in" of the correct code. This is accomplished either by introducing, into a suitable slot, a card carrying the code in the form of magnetic chips or tape, or by pushing a set of buttons in a preset sequence. In systems of greater sophistication, these two operations are combined, preventing the use of a lost or stolen card. However, while these "Credit-Card" keys and pushbutton units are of great value for access control in plants, offices and institutions, they are far too expensive to install and maintain in private homes and apartments or even small enterprises or shops.

It is an object of the present invention to overcome the disadvantages and limitations of the prior-art devices and to provide an electronic lock that is inexpensive, in fact, cheaper than a high-quality cylinder lock, dispenses with such means of access as cards or keys which are liable to get lost or stolen; has only a single pushbutton which can therefore be sturdy and constitutes also less of a "desirable" target for vandalizing than does the conventional calculator-type keyboard, and that triggers an alarm when tampered with, or fed the wrong code.

This the present invention achieves by providing a digital-code operated circuit for an electronic lock comprising switch means to alternatingly close and open a circuit to provide pulses of specific numbers and groupings constituting digits and a sequence of digits respectively, converting means to convert the number of said pulses per digit and the number of said groupings per digit sequence from serial to parallel, discrimination means to distinguish between discrete pulses constituting a single digit and between complete digits constituting a digit sequence, memory means to store the data produced by said converting means, program means in which said digital code can be set, verification means to verify whether the pulses provided by said pushbutton means produce digit sequences confirming to said digital code as set in said program means, wherein a signal for the unlocking of said lock is produced only by conformance with said code.

The invention will now be described in connection with certain preferred embodiments in the following examples so that it may be more fully understood. It is not, however, intended to limit the invention to these particular embodiments. On the contrary, it is intended that all alternatives, modifications and equivalents as may be included within the scope of the invention as defined by the appended claims be included herein.

Thus, the following examples which include preferred embodiments will serve only to illustrate the practice of this invention, it being understood that the particular formulations described are by way of example and for purposes of illustrative discussion of preferred embodiments of the present invention only and are presented in the cause of providing what is believed to be the most useful and readily understood description of formulation procedures as well as of the principles and conceptual aspects of the invention.

The electronic lock according to the invention is openable by tapping out, with the aid of a single pushbutton, a programmable code consisting of a sequence of n digits between 1 and 9. While, in principle, there is no limit to n, the fact that the possible number of different combinations of digits from 1 to 9 amounts to $9^n$ makes it obvious that, for all practical purposes, 4 to 6 digits per code will suffice ($9^4=6561$; $9^6=531441$).

Figure 1:
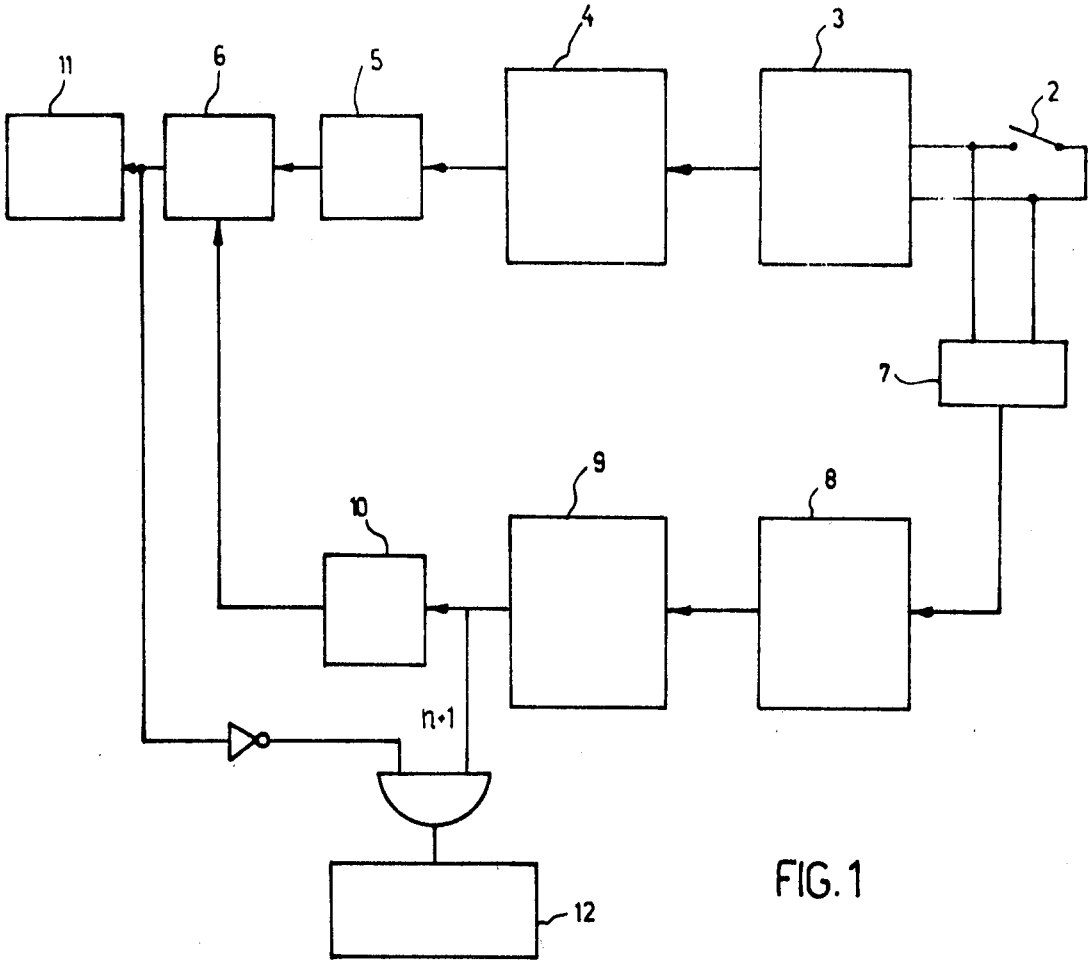
FIG. 1 is a block diagram of a first embodiment of the electronic lock according to the invention.

FIG. 1 is a block diagram of a first embodiment of the electronic lock according to the invention comprising a single pushbutton 2, a series-to-parallel converter 3, a decoder 4, a digit program 5, an addressable memory 6, a delay circuit 7, a second series-to-parallel converter 8, a second decoder 9, a number-of-digits and sequence-of-digits program 10, an electromechanical output device 11, and an alarm circuit 12.

To operate the electronic lock, pushbutton 2 is pressed a number of times equal to the value of each digit of the code, e.g., four times for the digit 4, twice for the digit 2, etc. To distinguish between the discrete pulses making up a digit, and between the digits as such, the interval between the pulses making up a digit must be kept short, (e.g., less than one second) while the interval between complete digits is, for example, at least 1.5 seconds. When these maximum and minimum intervals are observed and when all of the n digits keyed-in correspond to the programmed n-digit code, the lock will open after the last digit has been entered. When, on the other hand, the above interval conditions were not kept to and/or when one or more of the n digits keyed in do not correspond to the programmed code either in value or in sequence, the lock will not open after entering the last of the n digits. If now, presuming ignorance on the part of the user as to the required number of digits, a further digit is keyed-in, an alarm is triggered. In a preferred embodiment of the invention, this alarm comprises a buzzer located within the home or premises and a bell, siren or the like arranged in such a manner as to be strongly audible from the outside. At least this section of the alarm is disconnectable from within.

Figure 2:
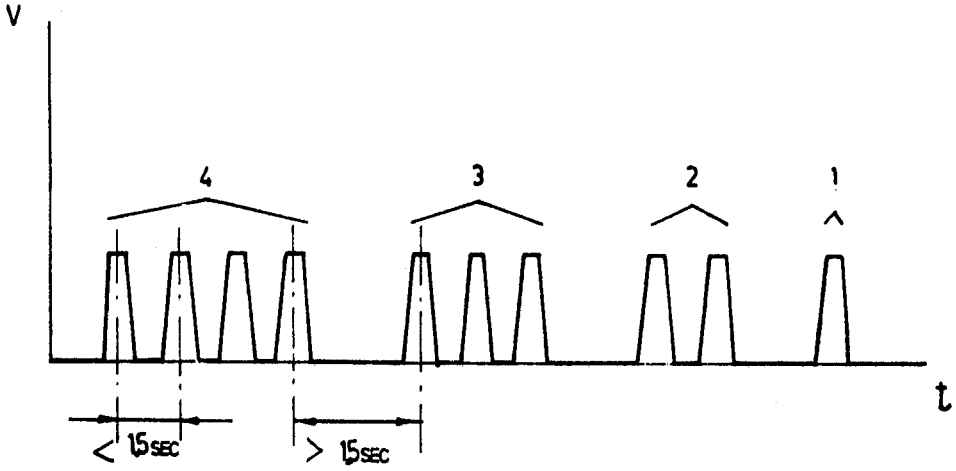
FIG. 2 is a schematic representation of the required input for a code number, e.g., 4321.

FIG. 2 is a schematic representation of the relative time intervals and pulse numbers required for the code 4321.

While the electronic lock is generally supplied by the mains, batteries are provided for cases of power failure.

Figure 3:
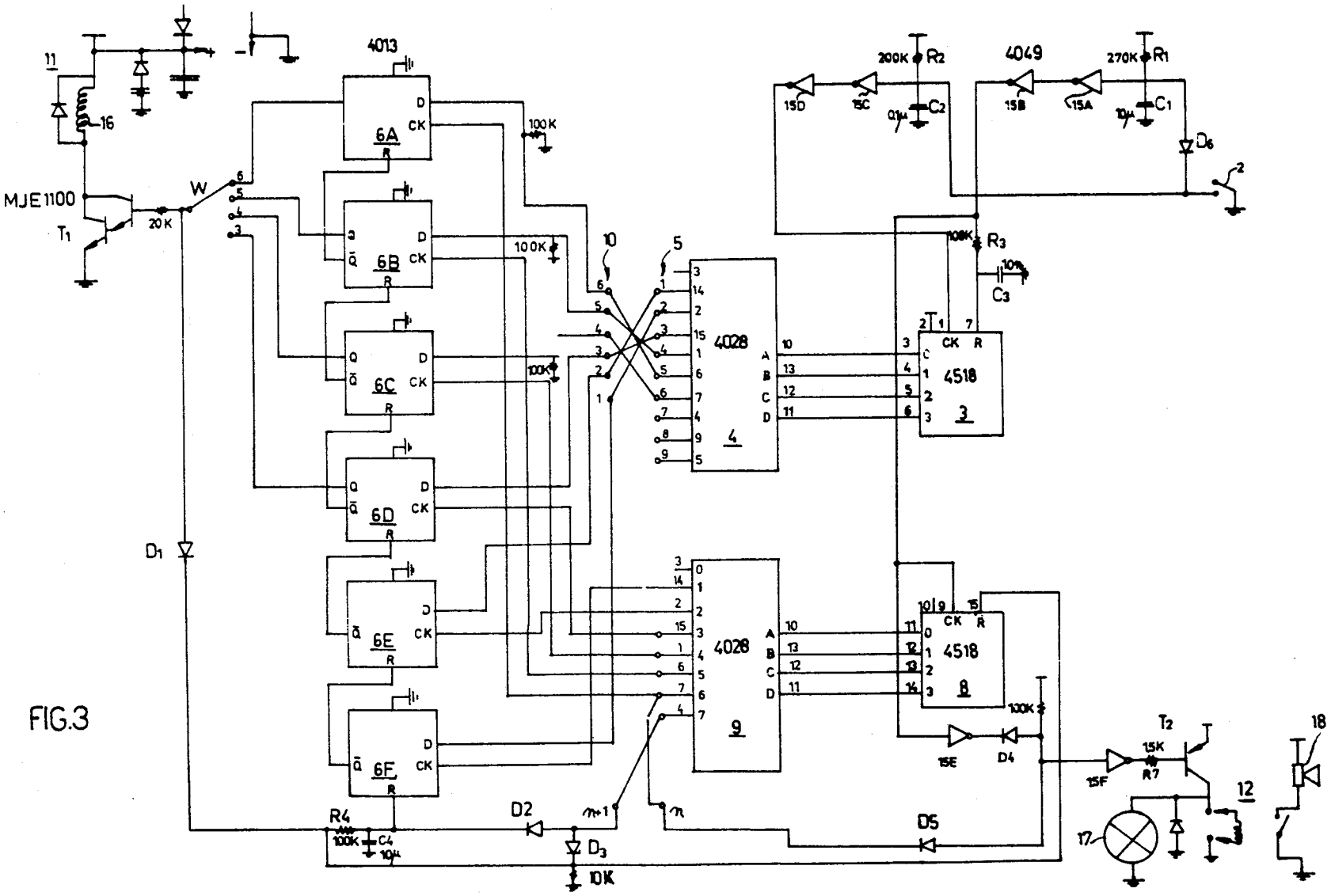
FIG. 3 is a more detailed circuit diagram of a 6-digit-code embodiment of the invention.

FIG. 3 represents a detailed circuit diagram of a 6-digit-code electronic lock according to the invention, programmed, by way of example, to the code 213645 and comprising a series-to-parallel converter 3 which counts the number of times the button 2 has been pressed for each digit; a series-to-parallel converter 8 which counts the number of complete digits (being separated from each other, as already mentioned, by an interval of at least 1.5 sec); a decoder 4 which converts the number of times the button has been pressed for each digit from binary to decimal; a decoder 9 which converts the number of complete digits keyed in from binary to decimal and facilitates the charging, each at its own time and at the logic lovel set for it by decoder 4 of the flip-flops 6A,6B, 6C, 6D, 6E, 6F, with 6F corresponding to the first digit and 6A—to the sixth; a filter circuit comprising resistor $R_2$, capaictor $C_2$, and inverters 15C and 15D, interposed between the pushbutton 2 and the converter 3; a delay circuit comprising resistor $R_1$, capacitor $C_1$, and inverters 15A and 15B, setting the delay between successive digits, with the delay time being determined by $R_1$ and $C_1$; a transistor $T_1$, actuating an electromechanical device 11, for example, a spring-bolt solenoid, and a transistor $T_2$, actuating the alarm 12.

To open the lock by "tapping out" the programmed code, one has to start from zero position, which prevails under two circumstances: (a) after the alarm 12 has been actuated due to the tapping out of the wrong code, or (b) after the lock has been opened as the result of the tapping out of the proper code.

In the zero position, converters 3 and 8 are in the 0 state, as are decoders 4 and 9. Flip-flops 6A and 6F are in the "reset" state.

When the button 2 is pressed, the following events occur:

(a) $C_1$ discharges and becomes logic "0", following which, converter 3 abandons its "reset" state;

(b) $C_2$ discharges, turning logic "0".

When button 2 is released, the following takes place:

(a) $C_1$ begins to be charged via $R_1$, attaining logic level "1" at a time constant $R_1 C_1$ (at least 1.5 seconds);

(b) $C_2$ is charged via $R_2$, attaining level "1" at a time constant of, for example, 100 μsec. When level "1" is attained, the count of converter 3 is advanced one step. With each further pressing of button 2, converter 3 will be further advanced, up to the first interval longer than the time constant $R_1 C_1$ (at least 1.5 sec).

If button 2 is left in the released state for more than 1.5 sec, the following will occur:

(a) $C_1$ is charged to attain logic "1".

(b) Converter 8 is advanced one step and converter 3 enters the "reset" state.

(c) Decoder 9 is lifted to level "1" and effects charging of flip-flop 6F to the level prevailing at that instant at terminal D of 6F, which, in this specific case, is fed by terminal 2 of decoder 4. If this terminal was on "1" (that is, if the first digit keyed in was 2), then flip-flop 6F will be raised to "1" and will release flip-flop 6E from its "reset" state and will enable it to become charged with the keying-in of the next digit, and so on.

When flip-flop 6A is raised to "1", the solenoid 16 of the electromechanical device 11 will be actuated by transistor $T_1$ for a period of time determined by $R_4 C_4$. The charging to the level "1" of $C_4$ via $D_1$ and $R_4$ will cause flip-flop 6F and, subsequently, also the other flip-flops, to revert to the "reset" state. Converter 8 is also caused to revert to the "reset" state via $D_1$, and the entire circuit returns to zero position.

The $R_3C_3$ circuit provides a delay between the resetting of converter 8 and that of converter 3, to facilitate the appropriate charging of the flip-flops.

It is enough if even one of the keyed-in digits is wrong, to leave the appropriate flip-flop in the "0" state and to prevent the other flip-flops from attaining level "1".

When of all six digits entered, even one does not snatch the programmed code, the following ocurs:

(a) flip-flop 6A remains at "0" and the solenoid 16 is not actuated;

(b) converter 8 remains at count 6, and so will decoder 9. Terminal 7 of decoder 9 will be at "1" and will pass on this voltage to the cathode of $D_5$.

If button 2 is pressed for a seventh digit as a reaction to the lock having failed to open due to the keying in of at least one wrong digit, then:

(a) $C_1$ and $C_2$ will discharge to "0";

(b) the cathode of $D_4$ will be raised to "1" via inverter 15E;

(c) Since the cathode of $D_5$ is also on "1", transistor $T_2$ becomes conductive via inverter 15F and activates the alarm 12.

Upon button 2 being released:

(a) A delay of 1.5 sec is introduced, during which the alarm still remains, activated;

(b) This delay having passed, converter 8 will be advanced to count 7, as will be decoder 9;

(c) Terminal 4 of decoder 9 will be raised to "1" and will cause converter 8 to revert to "reset", as will the flip-flops, via $D_2$ and $D_3$.

(d) The alarm 12 will be stopped and the circuit will revert to zero position.

In the embodiment shown in FIG. 3, a selector W permits the circuit to be set for code numbers having between 3 and 6 digits. Setting the code number itself is done by connecting the appropriate D-terminals of the flip-flops (advantageously lined up on a sequence board) with the appropriate digit terminals of decoder 4. To make programming still easier, digit switches could be provided.

The circuit can be operated at any voltage between 6 V and 15 V and, the components being of the CMOS type, uses up almost no power.

Depending on the specific use of the electronic lock, the alarm 12 may include a single sound or light-emitting device located anywhere in relation to the rest of the system or may include a plurality of similar or different known per se alarm devices such as buzzer 17 or bell or siren 18. Some of the alarm devices may be disconnectable at will.

Figure 4:
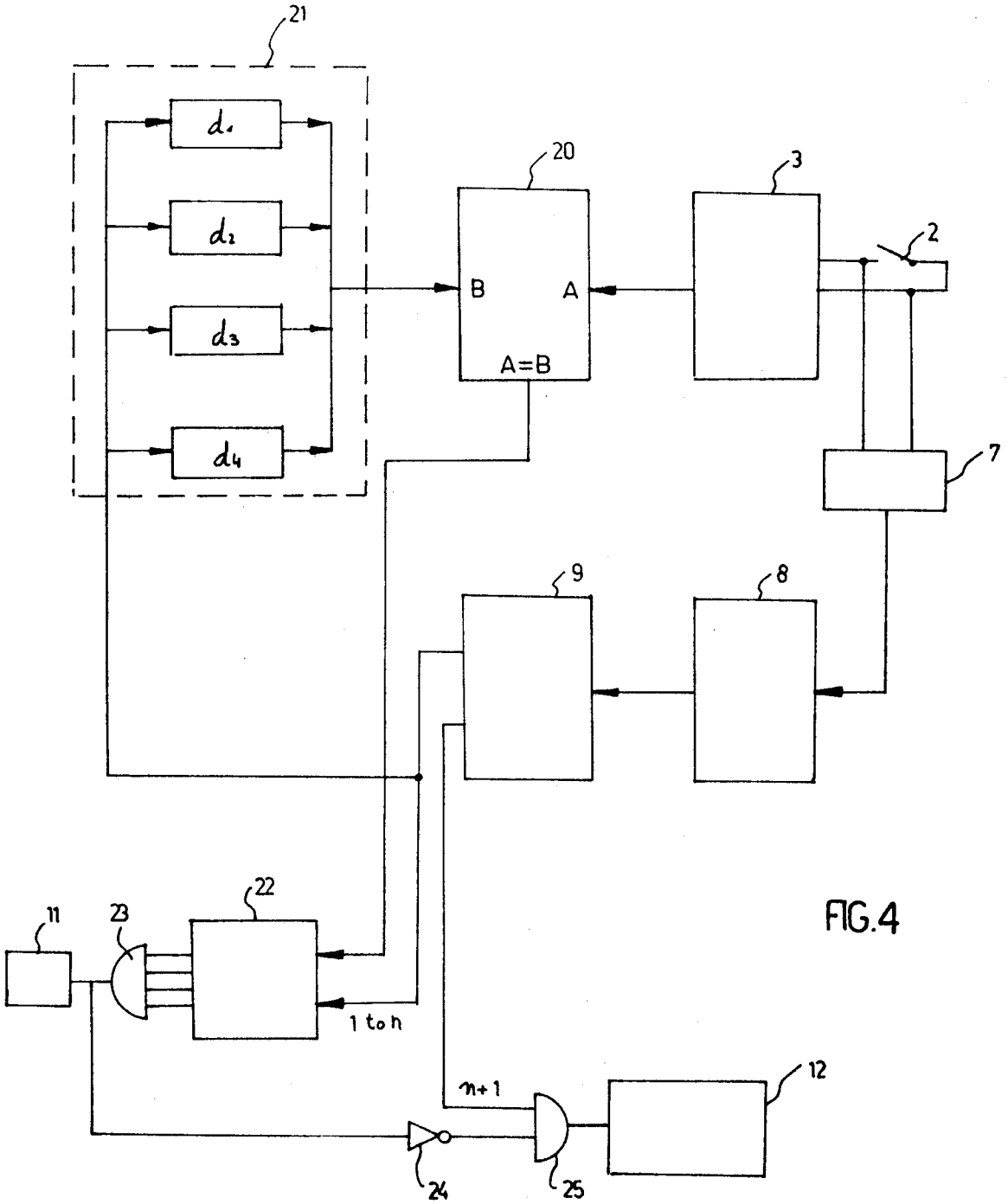
FIG. 4 is a block diagram of another embodiment of the electronic lock according to the invention.

The block diagram of another embodiment of the electronic lock according to the invention is shown in FIG. 4. This embodiment is by way of example arranged for a 4-digit code (n=4) and comprises, apart from the above-mentioned components (pushbutton 2, series-to-parallel converters 3 and 8, delay circuit 7, decoder 9, electromechanical output device 11 and alarm 12), a comparator 20, a 4-digit code program unit 21 comprising four digit switches $d_1$–$d_4$, an addressable memory 22 which remembers the keyed-in digits, and an AND-gate 23 which will permit the solenoid 11 to be actuated only if the programmed code has been properly keyed in.

In operation, the signals from pushbutton 2 are led via the series-to-parallel converter 3 as binary numbers to comparator 20. After a delay of about 1.5 sec, during which button 2 is not pushed, series-to-binary converter 8 is advanced one step, emitting a binary number which is delivered to decoder 9. This unit will supply a logic "1" to whatever sub-unit ($d_1$–$d_4$) of program 21 is to be addressed to check whether the keyed-in digit agrees with the code. If positive, comparator 20 will deliver a logic "1" to that address of memory 22 which is determined by decoder 9. The output of memory 22 will also be "1".

If the keyed-in digit differs from that demanded by the code, memory 22 is fed, and delivers, a logic "0". As in the previous embodiment, solenoid 11 will be actuated only if the digits will agree in value as well as sequence with the code set by program 21. Otherwise, the logic "0" delivered by AND-gate 23 and inverted by inverter 24, together with the n+1 output of decoder 9 will cause AND-gate 25 to actuate alarm 12, as soon as an (n+1)th digit is keyed-in.

By disconnecting the electronic lock from its current sources, the owner can prevent any access to his home.

It is possible to include in the circuit a number of components whereby the repeated mechanical pressing of the button required to key-in the digits is replaced by an electronic device providing appropriate signals. Such an arrangement would also include an optical display, for example, a 7-segment display unit which, with the button held down in the depressed state, would indicate the number of elapsed counts, to be reset to zero the moment the button is released. The convenience of such an arrangement is obvious.

While for the sake of clarity in the embodiments shown in the figures and described in the specification, the serial-to-parallel converter and the decoder have been shown as two separate units, it should be noted that these two units could be realized by a single unit which is a serial-to-parallel converter or by a similar unit such as a shift register which will be referred to in the claims as converter means and serial-to-parallel converter.

It will be evident to those skilled in the art that the invention is not limited to the details of the foregoing illustrative embodiments and that the present invention may be embodied in other specific forms without departing from the essential attributes thereof, and it is therefore desired that the present embodiments be considered in all respects as illustrative and not restrictive, reference being made to the appended claims, rather than to the foregoing description, and all changes which come with the meaning and range of equivalency of the claims are therefore intended to be embraced therein.

What is claimed is:

1. A digital-code operated circuit for an electronic lock comprising a single pushbutton to alternatingly close and open a circuit to provide pulses of specific numbers and groupings constituting digits and sequence of digits respectively, converting means to convert the number of said pulses per digit and the number of said groupings per digit sequence, from serial to parallel, discrimination means to distinguish between discrete pulses constituting a single digit and between complete digits constituting a digit sequence, memory means to store the data produced by said converting means, program means in which said digital code can be set, verification means to verify whether the pulses provided by said single pushbutton produce digit sequences conforming to said digital code as set in said program means, wherein a signal for the unlocking of said lock is produced only by conformance with said code.

2. The circuit according to claim 1, wherein said converting means are constituted by first and second serial-to-parallel converters.

3. The circuit as claimed in claim 1 wherein said converting means are constituted by a shift register.

4. The circuit according to claim 1, wherein said discriminating means are constituted by delay circuits.

5. The circuit according to claim 1, wherein said verification means are constituted by a comparator.

6. The circuit according to claim 1, wherein said verification means is a number-of-digits and sequence-of-digits program.

7. The circuit according to claim 1, wherein said single pushbutton constitutes means for actuating, in sequence, a first serial-to-parallel converter and via a digit program, an addressable memory; said pushbutton further actuating, in sequence, via a delay circuit, a second serial-to-parallel converter, the output signal of which is led via a number-of-digits and sequence-of-digits program to said addressable memory, wherein the keying-in, via said single pushbutton, of the programmed digital code produces a first output signal for the unlocking of said lock, whereas the keying-in of a code differing from said programmed digital code produces a second output signal for the triggering of an alarm connectable to said lock.

8. The circuit according to claim 1 wherein said single pushbutton constitutes means for actuating, in sequence, a first serial-to-parallel converter leading to a first input of a comparator, further actuating, in sequence, via said delay circuit, a second serial-to-parallel converter, and, via a first output of said converter providing signals to an adressable memory and a digit program the output of which program is led to a second input of said comparator wherein the keying-in, via said single pushbutton of said programmed digital code causes said comparator to provide an enabling signal to said memory only when an identify is established between the first and the second input signal of said comparator which memory produces a first output signal for the unlocking of said lock, whereas the keying-in of a code differing from said programmed digital code prevents said comparator from providing said enabling signal for the unlocking of said lock, thereby causing said memory to enable a second output of said converter to trigger an alarm connectable to said lock.

9. The circuit according to claim 1, further comprising alarm means, wherein said alarm means are activated only in the absence of said conformance.

10. The circuit according to claim 1, further comprising an electromechanical device actuatable by said unlocking signal produced by said circuit.

11. The circuit according to claim 1, further comprising means for selecting the number of digits required for the digital code to be set.

12. The circuit according to claim 1, wherein said program means is constituted by a set of terminals selectively interconnectable.

* * * * *